United States Patent [19]

Leclerc et al.

[11] 4,303,081

[45] Dec. 1, 1981

[54] PROCESS FOR LAYING OUT A MAXIMUM NUMBER OF WRAPPERS FOR CIGARS IN A LEAF OR HALF-LEAF OF TOBACCO

[75] Inventors: Jean-Francois Leclerc, Orleans; Jacques Paret, Fleury-les-Aubrais; Pierre Waegaert, Bordeaux, all of France

[73] Assignee: Service d'Exploitation Industrielle des Tabacs et des Allumettes, Paris, France

[21] Appl. No.: 117,291

[22] Filed: Jan. 31, 1980

[51] Int. Cl.[3] ..... A24C 1/00; A24C 1/04

[52] U.S. Cl. ..... 131/282

[58] Field of Search ..... 131/15 R, 120, 150, 131/122, 131, 132, 140 R, 149, 105

[56] References Cited

U.S. PATENT DOCUMENTS 4,222,396 9/1980 Anderson et al. ..... 131/120

4,226,148 10/1980 Logan et al. ..... 131/122

*Primary Examiner*—V. Millin

*Attorney, Agent, or Firm*—Holman & Stern

[57] ABSTRACT

A process for laying out a maximum number of cigar wrappers in a leaf or half-leaf of tobacco, the position of each wrapper being located within the leaf or half-leaf by two series of variables which are, on the one hand, the abscissa or ordinate from the center of the wrapper plotted with respect to the main direction of the leaf and to one end of this leaf, and on the other hand the angle that the main direction of the wrapper makes with the main direction of the leaf, said process comprising the step of successively laying out the wrappers so that, for each wrapper, the abscissa, or ordinate, from the center or its angle with respect to the main direction is maximum or minimum.

5 Claims, 3 Drawing Figures

Figure 1:
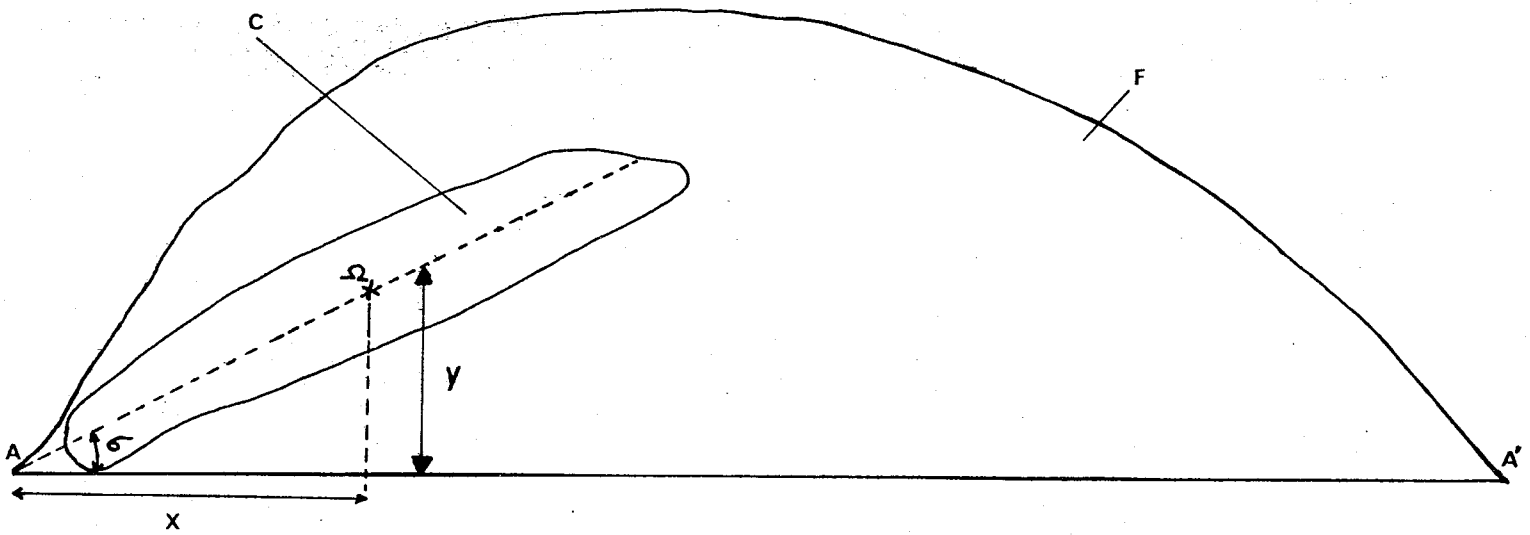

PROCESS FOR LAYING OUT A MAXIMUM NUMBER OF WRAPPERS FOR CIGARS IN A LEAF OR HALF-LEAF OF TOBACCO

The present invention relates to a process for laying out a maximum number of wrappers for cigars in a leaf or half-leaf of tobacco.

The position of each wrapper within the leaf or half-leaf is located by two series of variables which are, on the one hand, the abscissa from the centre of the wrapper plotted with respect to the main direction of the leaf and, on the other hand, the angle that the main direction of the wrapper makes with the main direction of the leaf.

It is an object of such a process to enable a maximum number of wrappers to be laid out and subsequently cut out, this being very important in view of the high price of the leaves or wrappers for cigars.

This process is applicable in a line for automatically producing cigar wrappers, wherein each leaf or half-leaf of tobacco is analysed to determine the number of wrappers which may be laid out therein, as well as the positions thereof within the leaf or half-leaf.

These operations must be carried out in a very short time. For each leaf, the optimal lay-out of wrappers may be effected one by one, but this would take a great deal of time if it were not sought to systematize the search for the optimal lay-out.

It is therefore necessary to prepare in advance wrapper lay out patterns which will be used once the leaf has been analysed.

To this end, the different types of leaf which are to be treated are firstly divided into classes, each class being determined as a function of the general contour of the leaf.

Predetermined wrapper lay out plans will be linked within each class.

For each class of leaves, procuring a given number of wrappers, there will be one or more lay out tactics, i.e. methods of laying out the wrappers with respect to one another. The lay out tactics thus indicate how to lay out the first wrapper in the leaf, how to lay out the second wrapper taking into account the position of the first, how to place the third wrapper taking into account the position of the second, and so on. The wrappers may thus be laid out as a fan with respect to the mid rib of the leaf or may be imbricated with respect to one another.

The lay out tactics to be employed, to make a wrapper-by-wrapper lay out, will follow, from a comparison with the state of the actual leaf, from a certain number of different lay out plans, preestablished according to different tactics.

It is an object of the present invention to set forth a process for systematically laying out wrappers in a leaf.

The position of a wrapper in a leaf is located by means of two positioning variables or criteria.

The first criterion employed is the position of the centre of the wrapper within the leaf. The projection of the centre of the wrapper onto the mid rib of the leaf is translated by a value expressed in abscissa, taking as origin one of the ends of the mid rib. The position of the centre of the wrapper is also given by a value expressed in ordinates also with respect to the mid rib of the leaf. The position of the centre is given entirely by the two abscissa and ordinate factors.

The other criterion is that of the angle which the main direction of the wrapper makes with the mid rib of the leaf, the wrapper being able to be more or less inclined with respect thereto.

FIG. 1 shows, for a wrapper C, disposed in a half-leaf of tobacco F, the two criteria of positioning of the centre of the wrapper C. The abscissa and ordinate values are indicated by X and by Y plotted with respect to the mid rib A A′ of the half-leaf F, the origin being taken from A.

The value of the angle made by the main direction of the wrapper C with the mid rib A A′ is indicated by Σ.

It is easy to imagine that the number of wrappers C which may be laid out in the half-leaf F will vary according to the values which will be attributed to the criterion of positioning of the centre of the first wrapper, the second, the third, etc. These values develop from a minimum value to a maximum value, passing through all the intermediate values. If it is desired to make full use of all the possibilities of the half-leaf by laying out the maximum number of wrappers thereon, the lay-out of each wrapper must be envisaged as a function of the particular judiciously chosen values of the positioning criterion. The use of any values whatever would in fact result in gaps in the lay-out between the wrappers and, at the end of the operation, the number of wrappers laid out would be less than the maximum number which could really be laid out.

According to the invention, the wrappers are laid out by combining the maximum and minimum values of the positioning criteria. All the maximum values on the one hand and all the minimum values on the other hand, or the maximum and minimum values may thus be combined.

The lay-out of the wrappers will preferably be effected by combining the criteria of the same category: abscissa, ordinate or angle.

Figure 2:
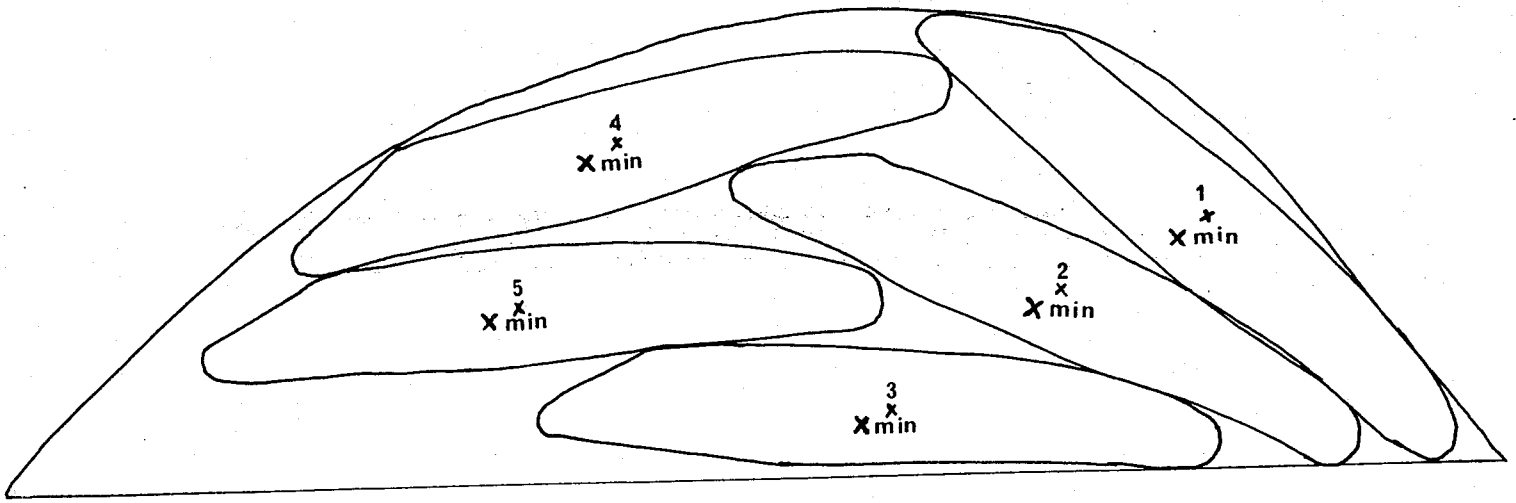

The criteria of the same category will advantageously be given either their maximum value possible or their minimum value possible. FIG. 2 gives an example of lay-out of 5 wrappers in a half-leaf, all the wrappers having been laid out by using the criterion for the centre to be at the minimum value possible of its abscissa.

The lay-out of the wrappers may also be effected by combining the two categories of positioning criteria. In this case, for one category, the maximum value possible will be adopted and, for the other category, the minimum value possible.

Figure 3:
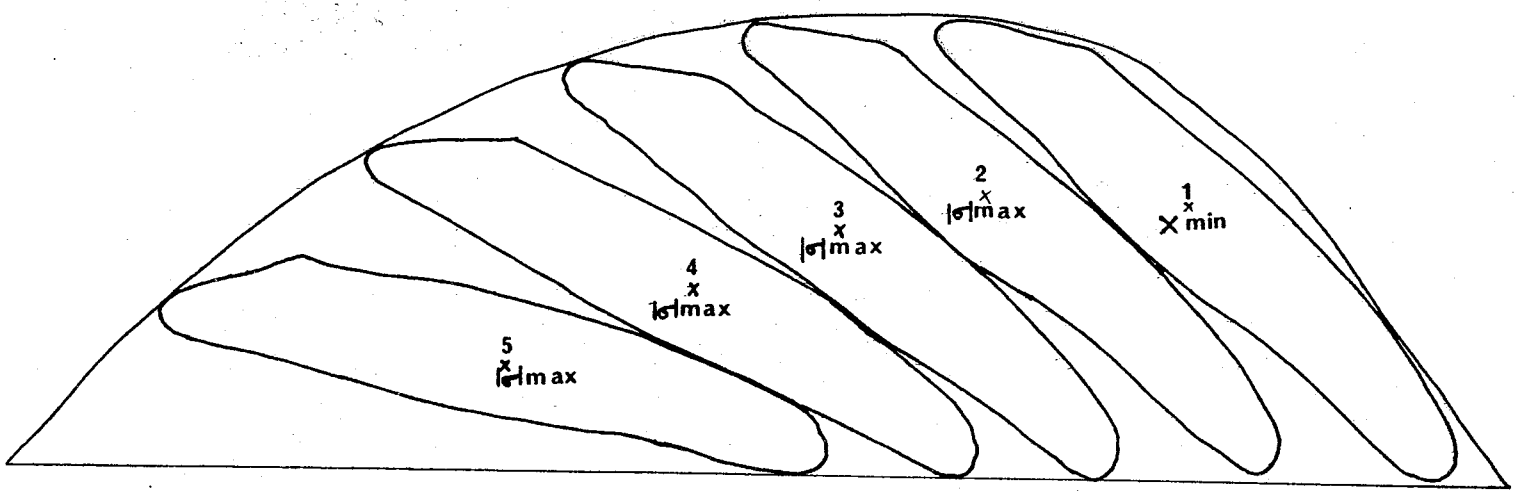

FIG. 3 gives an example of lay-out of 5 wrappers in a half-leaf in which the two positioning criteria have been used. The first wrapper is laid out by using the criterion for the abscissa from the centre to be at its minimum value possible, whilst the following four wrappers are laid out by using the criterion of the maximum angle possible.

By using different criteria of choice of centre for each wrapper, these different criteria being given their maximum or minimum value possible, numerous lay out plans may thus be made, proceeding from different layout tactics. These operations are prepared in advance, once and for all, for each class of leaf. The result of this work is used when examining the actual leaf and thus allows an appreciable saving of time to be made.

Although the example given is directed only to natural tobacco leaves, it will be appreciated that the process of the invention is applicable in a large number of industries and more especially those which deal with natural products having more or less random shapes and blemishes. Thus the interest of the process is obvious for the leather industries, and particularly the shoe manufacturing industry. The transposition of the process of the invention from the cigar industry to other industries is made simply by replacing, in the preceding text and in the claims, the words "leaves" and "wrappers" by "flat pieces of irregular surface" and "shapes of determined contour", respectively.

What we claim is:

1. A process for laying out a maximum number of cigar wrappers in a leaf or half-leaf of tobacco, the position of each wrapper being located within the leaf or half-leaf by two series of variables which are, on the one hand, the abscissa or ordinate from the center of the wrapper plotted with respect to the main direction of the leaf and to one end of the leaf, and on the other hand, the angle that the main direction of the wrapper makes with the main direction of the leaf, said process comprising the steps of laying out a first wrapper so that it is tangential to the contour of the half-leaf and one of its said variables is maximum or minimum, and then successively laying out other wrappers, each of them being always tangential to the last laid out wrapper and to the contour of the half-leaf or to another laid out wrapper and having one of its said variables maximum or minimum.

2. A process as claimed in claim 1, in which it is the abscissae or ordinates from the centers of the wrappers which are maximum or minimum.

3. A process as claimed in claim 1, in which it is the angles of all the wrappers which are maximum or minimum.

4. A process as claimed in claim 1, in which it is the abscissae, or ordinates, from the centers of some of the wrappers which are minimum and it is the angles of the other wrappers which are maximum.

5. A process as claimed in claim 1, in which it is the abscissae, or ordinates, from the centers of some of the wrappers which are maximum and it is the angles of the other wrappers which are minimum.

* * * * *